United States Patent [19]

Kuhlmann et al.

[11] Patent Number: 5,060,502

[45] Date of Patent: Oct. 29, 1991

[54] HYDRAULICALLY-OPERATED STRIPPING DEVICE

[75] Inventors: Wolf Kuhlmann, Nürnberg; Dieter Hesse; Karl Kögel, both of Erlangen, all of Fed. Rep. of Germany

[73] Assignee: FAG Kugelfischer Georg Schafer, Fed. Rep. of Germany

[21] Appl. No.: 561,190

[22] Filed: Aug. 1, 1990

[30] Foreign Application Priority Data

Aug. 9, 1989 [DE] Fed. Rep. of Germany ..... 3926279

[51] Int. Cl.[5] ..... B21D 1/12

[52] U.S. Cl. ..... 72/392; 72/705

[58] Field of Search ..... 72/392, 705

[56] References Cited

U.S. PATENT DOCUMENTS

| | | | |
|---|---|---|---|
| 2,010,713 | 8/1935 | Countryman | 72/705 |
| 2,165,503 | 7/1939 | Pfauser | 72/705 |
| 3,304,059 | 2/1967 | Siliznoff et al. | 72/392 |
| 3,762,688 | 10/1973 | Leonhardt . | |
| 4,122,699 | 10/1978 | Logsdon | 72/705 |

FOREIGN PATENT DOCUMENTS 2621249 9/1978 Fed. Rep. of Germany .

*Primary Examiner*—Lowell A. Larson

*Attorney, Agent, or Firm*—Ostrolenk, Faber, Gerb & Soffen

[57] ABSTRACT

A stripping device for enlarging an opening in sheet material and possibly for initially forming and then enlarging the opening. A hydraulically operated cylinder has a cylinder housing around it. A piston in the cylinder is connected to move a shoe that is guided on the cylinder housing. A clamping jaw is attached to the cylinder housing. An axially displaceable stripping jaw is connected to the piston either by a rod on the piston or that jaw is attached on the shoe and moves with the shoe. The shoe may have a plurality of spaced attachment points for the stripping jaw. There may be an extension of the piston on which the stripping jaw is carried or on which an additional sripping jaw is carried. There may be an extension of the cylinder housing on which an additional clamping jaw is carried.

11 Claims, 9 Drawing Sheets

HYDRAULICALLY-OPERATED STRIPPING DEVICE

BACKGROUND OF THE INVENTION

The present invention relates to a hydraulically-operated stripping device used for stripping sheet material to form manholes, or the like, and particularly to the hydraulic operation of the stripping jaws.

A hydraulically operated accident rescue device having spreading jaw means is known from German Patent 26 21 249 of the inventor (assignee) hereof. Various tools can be installed on the tips of the spreading jaws so that, when those jaws are a clamping jaw and a stripping jaw, the accident rescue device can also be used for creating a manhole in a crashed vehicle to afford the rescue team access into the vehicle. The applicant's publication HR 411 65/3D/E5 entitled "Lukas Rescue Systems" shows in the photo on the bottom right of the last page the use of a spreader which is provided with a clamping jaw and a stripping jaw as a stripping device for creating a manhole. The clamping and stripping jaws are shown, for instance, on page 3 of the brochure and their use is described on page 15 in Items 509/510. These rescue devices have proven themselves many times in practice.

Disadvantages are found in the prior designs. Some use jaws placed on arms that are movable relative to each other. Due to the kinematics of some known spreaders, the smallest spreading force is available at the beginning of the stripping process, although the maximum force is required especially at that time in order to cause the sheet metal to tear. The closed arms of the spreader, which are provided with the clamping jaw and the stripping jaw, are in this case inserted into a small hole which has previously been created. The cylinder is then placed under pressure and while the clamping jaw remains stationary, the arm bearing the stripping jaw spreads to peel a strip of sheet metal from the wall of the vehicle.

SUMMARY OF THE INVENTION

It is therefore the object of the invention to provide a stripping device for creating a manhole, or the like opening, in sheet material and particularly sheet metal material. The manhole may be needed in a surface of a crashed vehicle, such as a land, water or air vehicle, or may be needed in doors, roofs, walls, boilers, or for the like uses.

The stripping device of the invention uses a clamping jaw and a stripping jaw which are moveable relative to each other, and the stripping jaw is particularly the movable one. A hydraulic cylinder has a piston which moves the axially displaceable stripping jaw with respect to the clamping jaw. The clamping jaw is carried on the cylinder or cylinder housing. The stripping jaw is acted on by the piston through a rod on the piston. This hydraulic cylinder piston arrangement supplies the maximum force at the beginning of the stripping process, avoids inward movement of the clamping and stripping jaws, and is of lightweight construction despite the long actuation paths over which its jaws travel, The stripping jaw can be arranged on a shoe connected to the piston rod and guided by the cylinder housing or the stripping jaw can directly or by means of an extension be placed on the piston rod. If an extension is provided, it moves the stripping jaw further from the clamping jaw which enables a larger opening to be formed in the sheet metal.

There may be an additional stripping jaw and/or an additional clamping jaw spaced further from the other relatively movable jaw for also increasing the size of the opening that can be formed in the sheet metal. Also, there may be an extension on the cylinder with an additional clamping jaw placed on the cylinder extension, again to increase the distance between the clamping and stripping jaws. There may be a number of locations along the cylinder housing on which the stripping jaw can be positioned. A shoe extending along the cylinder housing and attached to the piston or the piston rod for being moved thereby can be of sufficient axial length to provide a number of attachment points for the stripping jaw. Alternatively, there can be an extension of the cylinder housing and the stripping jaw can be placed on that.

For forming an initial opening in the sheet metal material, which initial opening would be of sufficient size to receive both the stripping and the clamping jaws for initiating the stripping action, a mandrel may be positioned either on the piston rod at one end of the device or on the end of the cylinder at the opposite end of the device. That mandrel is shaped and adapted for forming an initial opening in the sheet material into which the clamping jaw and the stripping jaw can later be inserted for operation to complete the stripping of the sheet material.

The shoe, the stripping jaw or the cylinder bottom can in an advantageous manner be provided with a mandrel-like attachment so that the initial opening can also be impressed by means of the stripping device.

Other objects and features of the invention are explained below with reference to an embodiment shown in the drawings.

DESCRIPTION OF THE PREFERRED EMBODIMENTS

Figure 1:
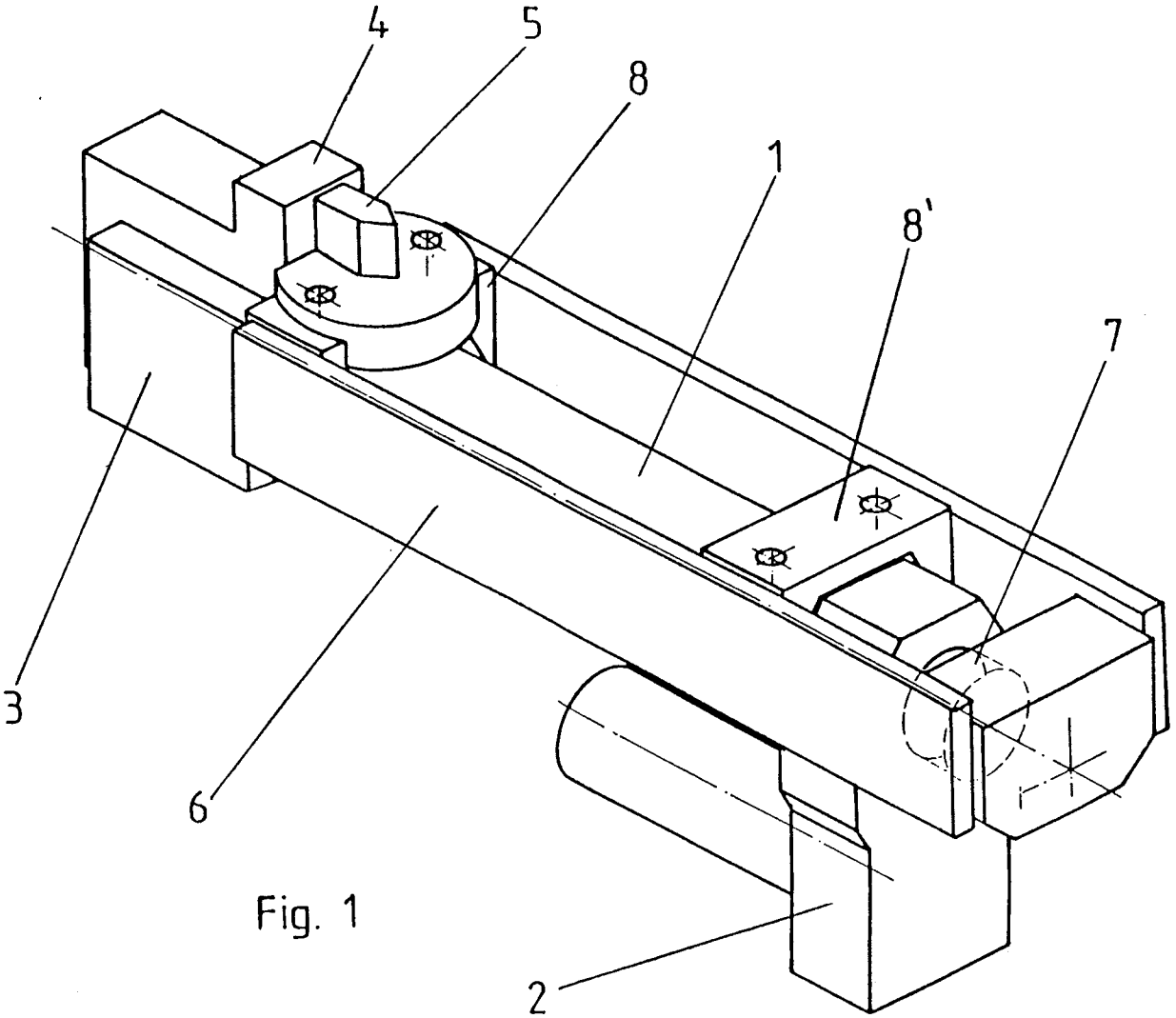
FIG. 1 is a perspective view of a stripping device according the invention, shown in its basic position at the start of the stripping process.

In FIG. 1, the hydraulic cylinder 1 corresponds in its basic construction to that of known rescue cylinders, such as that shown on page 8 of the above mentioned publication of the applicant. A control valve 2 is located at the end of the hydraulic cylinder toward the piston rod end for pressurizing the cylinder. A clamping jaw 4 is attached to the cylinder bottom 3 which is below the jaw 4.

Facing the clamping jaw there is a stripping jaw 5 which is attached to a shoe 6. The shoe is acted upon by the piston rod 7 and is axially displaceable.

Figure 2:
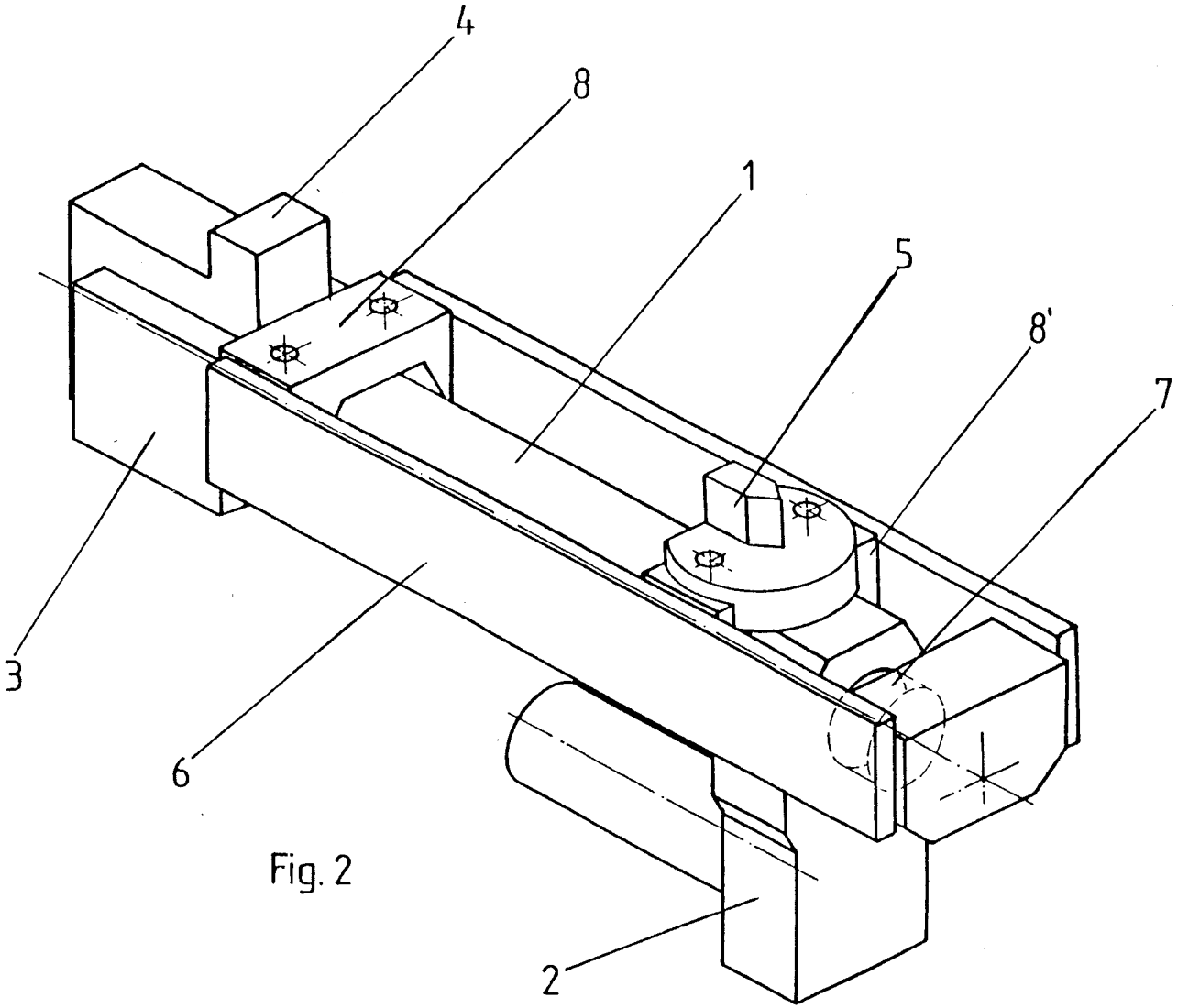
FIG. 2 shows the stripping device of FIG. 1 in its basic position before the second stroke.

The shoe 6 is guided on the housing of the hydraulic cylinder 1. The shoe has at least one point of attachment 8 along its length and preferably additionally has another point of attachment 8' along its length for the stripping jaw 5, as shown in FIG. 2. For various applications, one or the other attachment points 8, 8' or even others may be used.

Figure 3:
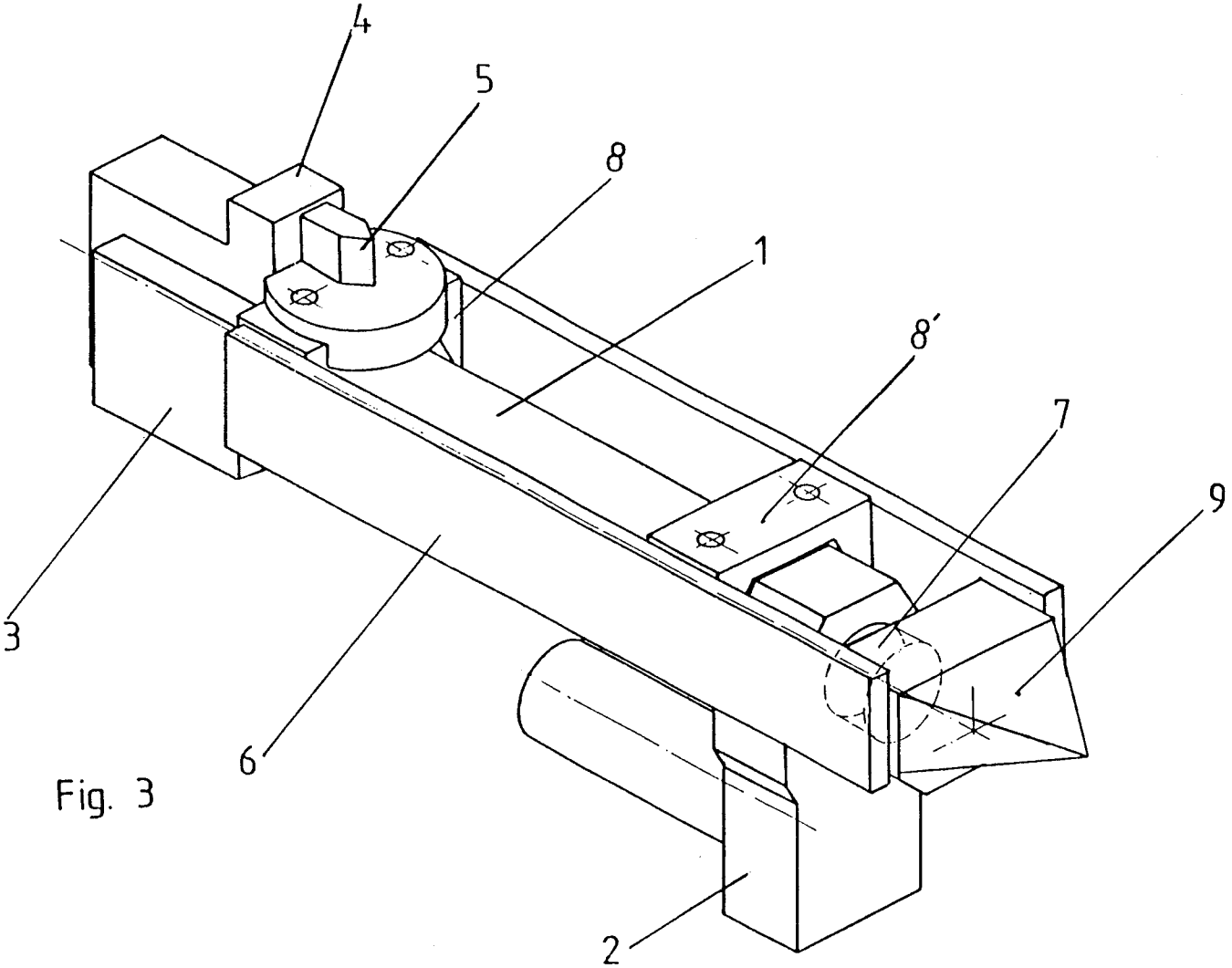
FIG. 3 shows a stripping device according to FIG. 1 with a mandrel arranged on the shoe.

In accordance with FIG. 3, a mandrel 9 for impressing the initial opening in the sheet metal is arranged on the shoe 6. Once that opening has been formed, the jaws 4 and 5 are inserted and are then spread apart.

Figure 4:
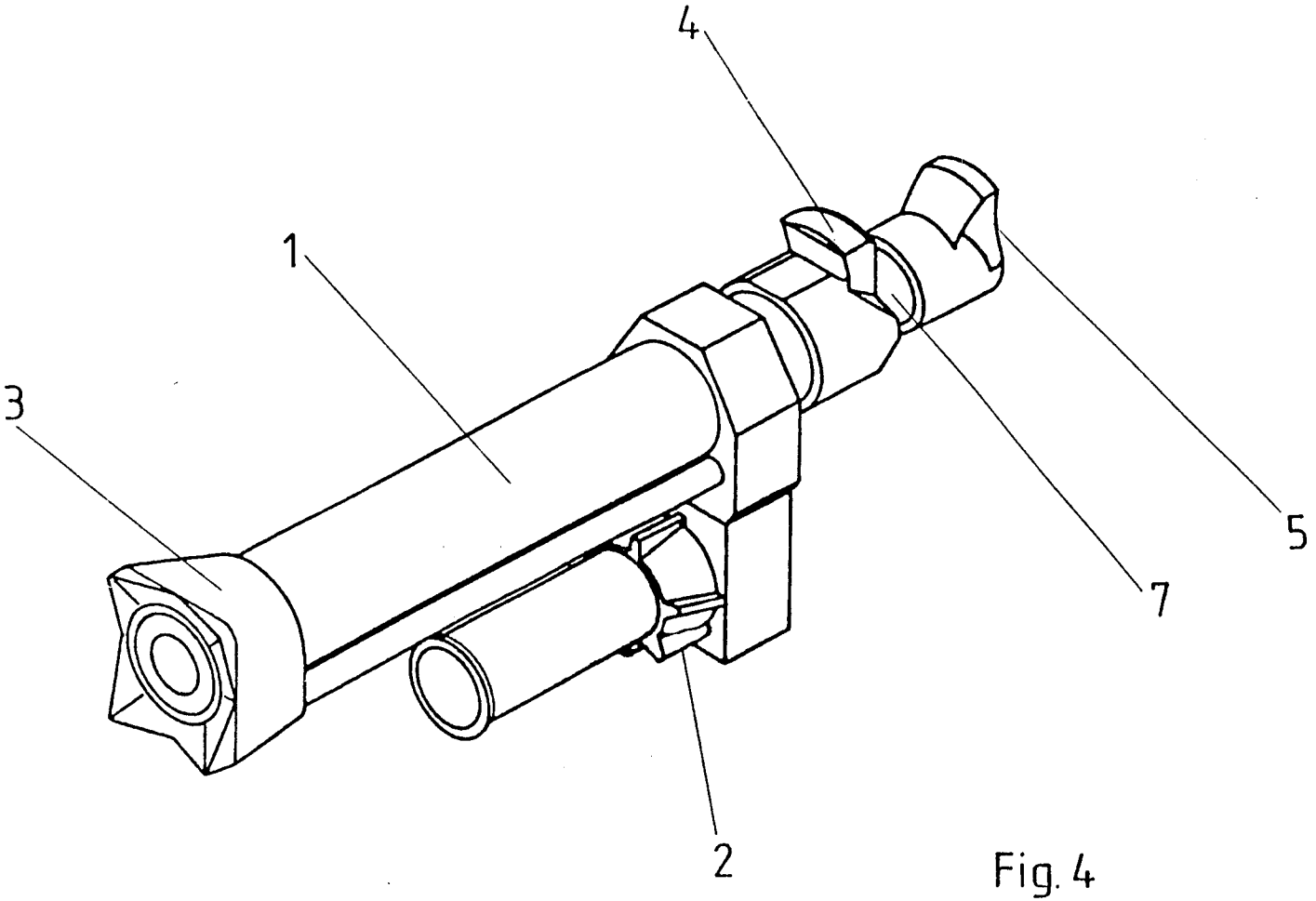
FIG. 4 shows a stripping device in accordance with the invention with a stripping jaw arranged on the piston rod, seen in its basic position.
Figure 5:
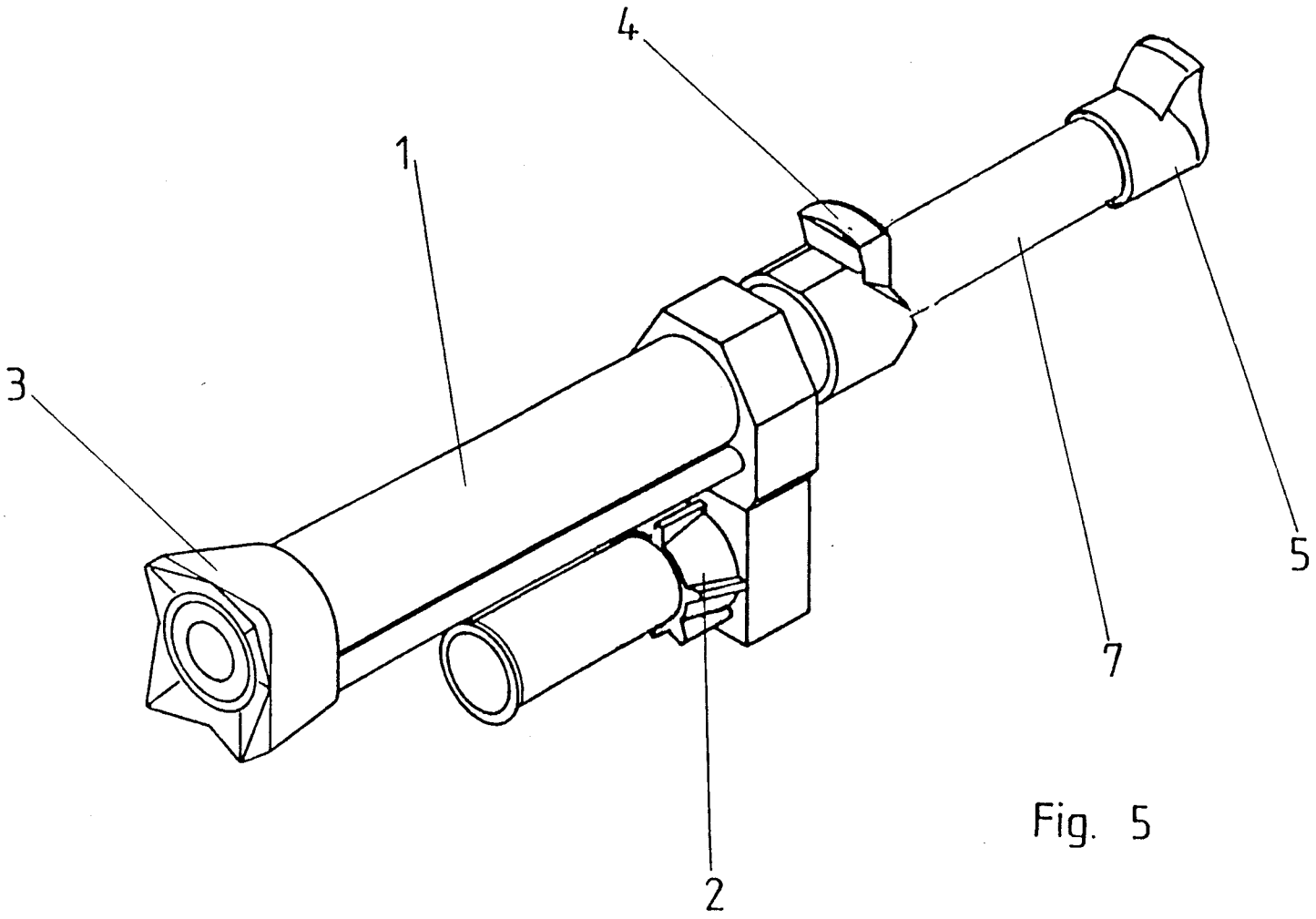
FIG. 5 shows a stripping device in accordance with FIG. 4 with the piston rod extended.

FIGS. 4 and 5 show another embodiment of the stripping device of the invention. The hydraulic cylinder 1 having the control valve 2 and the cylinder bottom 3, has a stripping jaw 5 which is attached directly to the piston rod 7 inside the cylinder 1. The clamping jaw 4 is attached on the piston rod end of the cylinder housing.

Figure 6:
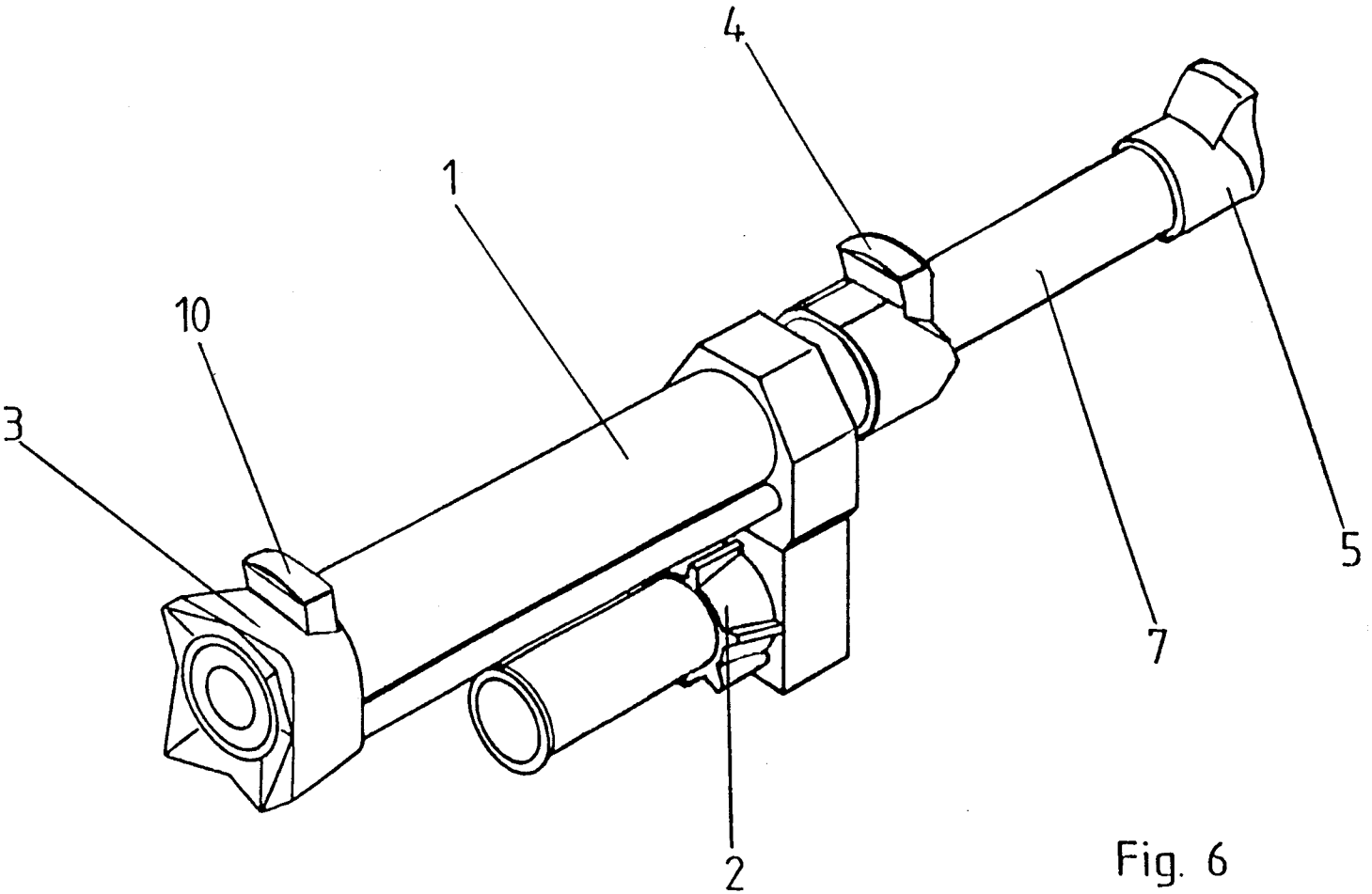
FIG. 6 shows a stripping device in accordance with FIG. 5 with an additional clamping jaw which is arranged on the cylinder bottom.

In FIG. 6, another clamping jaw 10 is arranged on the cylinder bottom 3. The jaw 10 enters into action upon the second stroke. In this way, the actuation path of the stripping device can be almost doubled.

Figure 7:
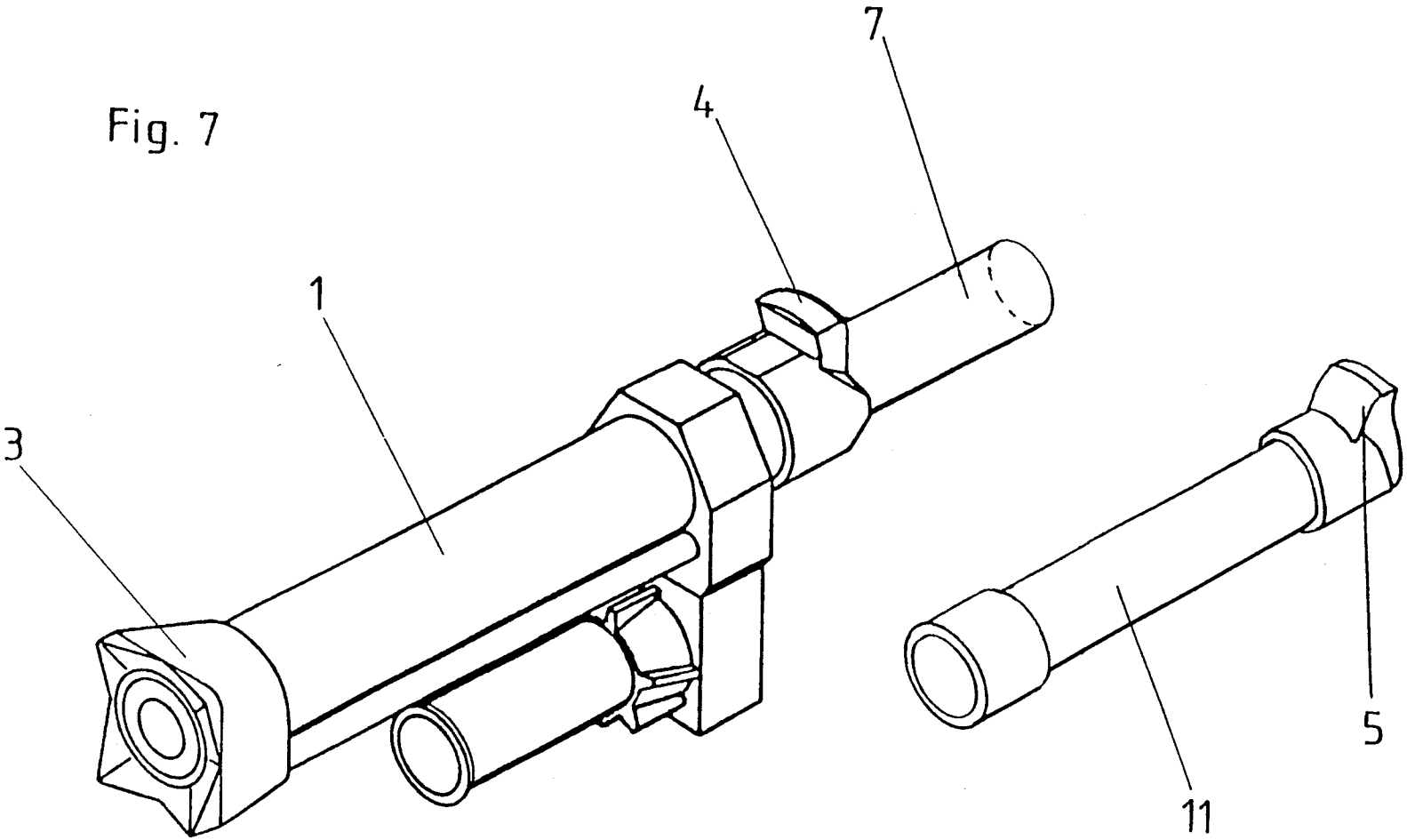
FIG. 7 shows a stripping device having a stripping jaw which is arranged on an extension.

As can be noted from FIG. 7, the actuation path can also be lengthened by the use of an extension 11 which is placed on the piston rod 7 upon the second stroke.

Figure 8:
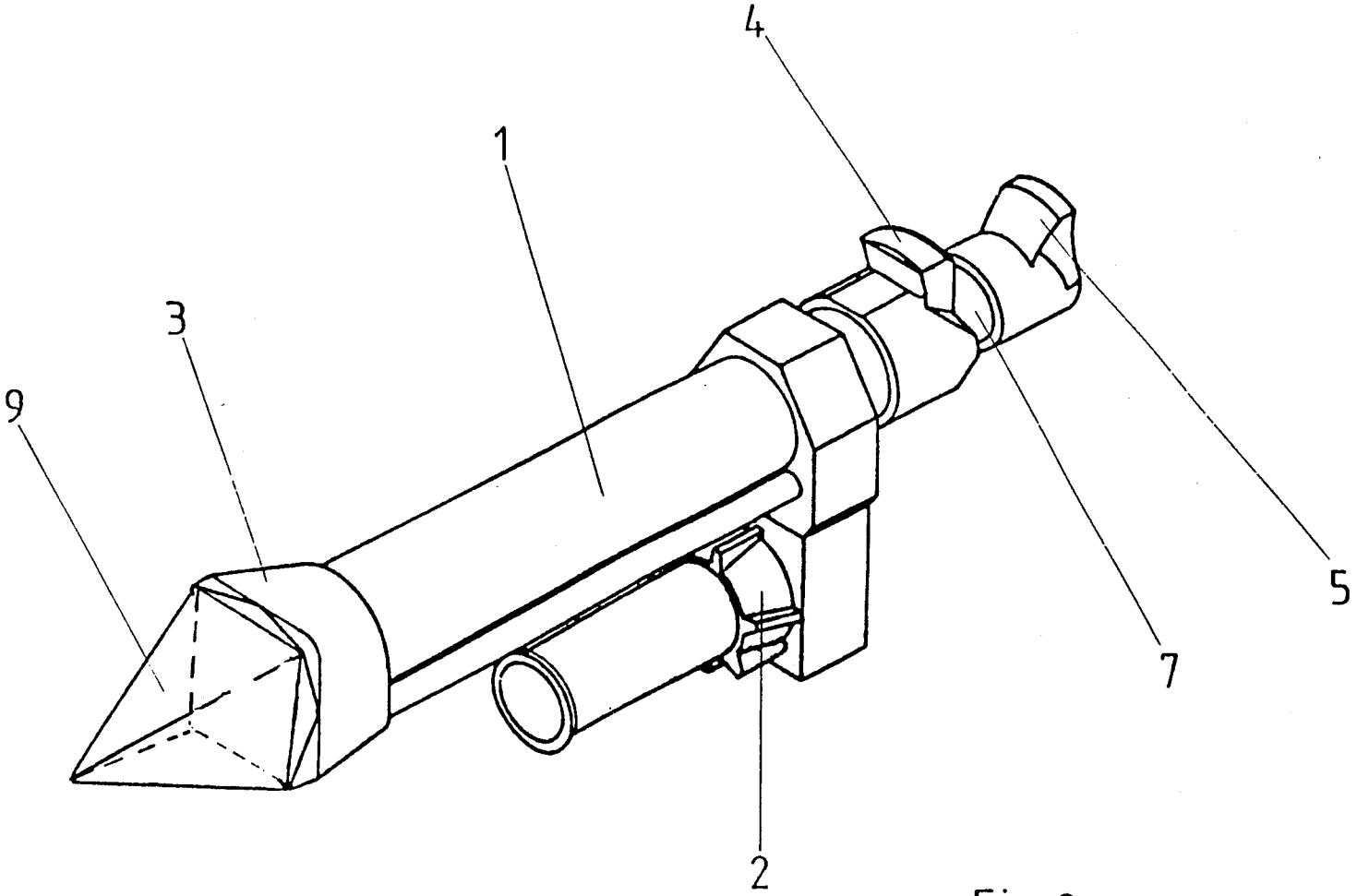
FIG. 8 shows a stripping device having a mandrel which is arranged on the cylinder bottom.

In the embodiment in FIG. 8, a mandrel 9, which serves to impress the initial opening in the sheet metal, is arranged on the cylinder bottom 3.

Figure 9:
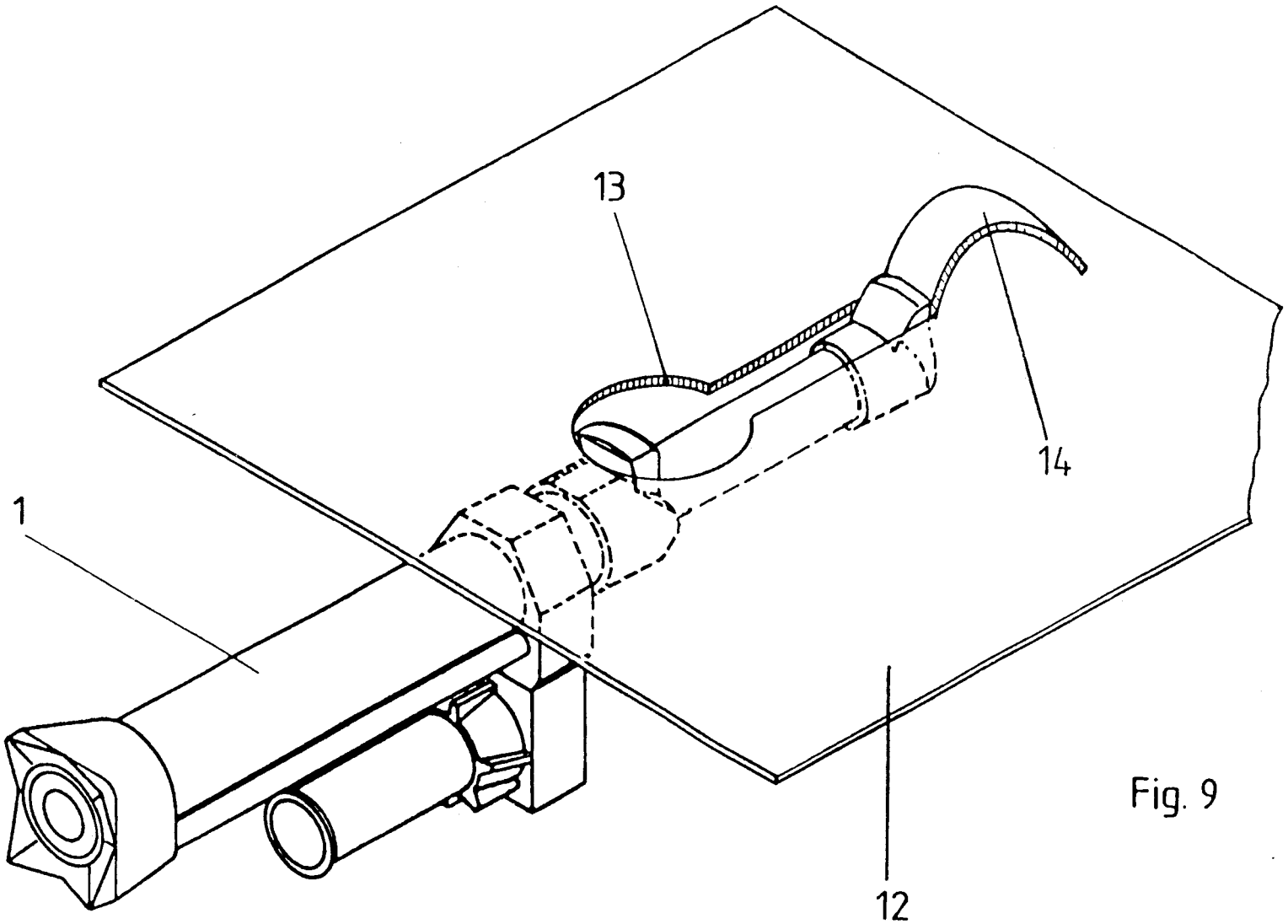
FIG. 9 shows a stripping device during the stripping process.

FIG. 9 shows a stripping device of the invention during use. A manhole is to be created in the wall 12. Sheet metal thicknesses of up to 7 mm can be peeled. During the first operation, the initial opening 13 is produced, for instance, by arranging the mandrel 9 of the stripping device of FIG. 8 approximately perpendicular to the plane of the wall 12, with the piston rod 7 resting against an abutment (not shown). The hydraulic cylinder 1 is then placed under pressure, which extends the piston rod 7 and pushes the mandrel 9 into the wall 12, producing the initial opening 13. The mandrel and/or the piston rod are again retracted. The clamping jaw 4 and stripping jaw 5 of the stripping device are both inserted into the initial opening 13. The hydraulic cylinder is again placed under pressure. A s a result, the piston rod 7 with the stripping jaw 5 is extended and peels or strips a sheet metal strip 14 out of the wall 12 (FIG. 9). After completion of the first stroke, the piston rod is again retracted, and the stripping device of FIG. 6 is inserted with its additional clamping jaw 10 into the initial opening 13 and the slot that had just been produced. The hydraulic piston 1 is again placed under pressure. As a result, the stripping jaw 5 peels further forward and lengthens the slot. If necessary, the piston rod 7 can be retracted yet again in a third operation, the extension 11 can be placed on and the slot can be lengthened still further by an additional stroke.

The procedure is similar with a stripping device according to FIG. 1 or FIG. 2, in which case the stripping jaw is attached, as required, at the corresponding attachment point 8 or 8' on the shoe 6. For producing the initial opening 13, the mandrel can of course also be arranged on the head of the shoe 6 or, together with the stripping jaw, the mandrel can be developed as an attachment set.

With the stripping device of the invention, the maximum force of the hydraulic cylinder is available from the very start over the entire stroke of the piston. As shown by a comparison with the spreader indicated on page 3 of the above mentioned prior art publication, this spreader has a spreading path at the tips of 820 mm, with a mass ready for operation of 28 kg and a spreading force of 60–80 kN. A stripping device having a hydraulic cylinder of type 12/300 (see page 8 of the above-mentioned publication) achieves, with a mass ready for operation of 13.5 kg and a pressing force of 120 kN, a maximum displacement path of at least 600 mm (first stroke 300 mm+second stroke 300 mm) and a path up to 1000 mm can be achieved when using an extension 11, i.e. a definite increase in performance with a simultaneous reduction in weight. All embodiments are compact units.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A hydraulic operated stripping device for creating a hole in sheet material comprising:

a hydraulic cylinder including a cylinder housing outside the cylinder, a piston rod in the cylinder and being movable relative to the cylinder, and hydraulic means for pressurizing the cylinder for moving the piston;

a clamping jaw attached to the cylinder housing; an axially displaceable stripping jaw connected with the piston for being moved by the piston in a direction away from the clamping jaw; the stripping jaw and the clamping jaw being adapted for insertion into an opening in the sheet material and such that with the cylinder pressurized for moving the piston with respect to the cylinder, the stripping jaw is moved away from the clamping jaw for enlarging an opening in the sheet material;

a mandrel attached on the piston and supported thereby, the mandrel being shaped and of a character to form an initial opening in the surface to be stripped, the mandrel being shaped such that the initial opening formed is of a size to initially receive the clamping jaw and the stripping jaw therein before the cylinder is pressurized to move the clamping and stripping jaws apart.

2. The hydraulically operated stripping device of claim 1, wherein the piston includes a rod extending therefrom and movable therewith and the stripping jaw is mounted on the piston rod.

3. The hydraulic operated stripping device of claim 1, wherein the cylinder has a bottom side and the clamping jaw is attached to the cylinder bottom side.

4. The hydraulically operated stripping device of claim 3, wherein the piston further comprises a shoe supported on and axially movable with respect to the cylinder housing, the shoe being connected with the piston for being moved thereby and the stripping jaw being mounted to the piston for being mounted to the shoe to be moved thereby.

5. The hydraulically operated stripping device of claim 4, wherein the cylinder housing includes a guide for the shoe and the shoe extends along the cylinder housing and is guided to move by the guide on the cylinder housing as the piston moves the shoe.

6. The hydraulically operated stripping device of claim 5, wherein the shoe extends a distance along the cylinder housing and the shoe has a plurality of attachment points spaced along the cylinder housing for attaching the stripping jaw to the shoe at any of the points along the shoe.

7. The hydraulically operated stripping device of claim 6, wherein the shoe has a first end toward the clamping jaw and a second end spaced away from the clamping jaw, and at least one of the attachment points being arranged toward each of the first and second ends.

8. The hydraulically operated stripping device of claim 1, wherein the mandrel is attached on the stripping jaw and is supported thereby.

9. A hydraulically operated stripping device for creating a hole in sheet material comprising:

a hydraulic cylinder including a cylinder housing outside the cylinder, a piston rod in the cylinder and being movable relative to the cylinder, and hydraulic means for pressurizing the cylinder for moving the piston;

a clamping jaw attached to the cylinder housing; an axially displaceable stripping jaw connected with the piston for being moved by the piston in a direction away from the clamping jaw; the stripping jaw and the clamping jaw being adapted for insertion into an opening in the sheet material and such that with the cylinder pressurized for moving the piston with respect to the cylinder, the stripping jaw is moved away from the clamping jaw for enlarging an opening in the sheet material;

a mandrel on the cylinder housing supported thereby, and the mandrel being shaped and of a character to form an initial opening in the surface to be stripped, the mandrel being shaped such that the initial opening formed is of a size to initially receive the clamping jaw and the stripping jaw therein before the cylinder is pressurized to move the clamping and stripping jaws apart.

10. The hydraulically operated stripping device of claim 9, wherein the piston includes a piston rod extending therefrom and movable therewith and the stripping jaw is mounted on the piston rod.

11. The hydraulically operated stripping device of claim 9, wherein the piston further comprises a shoe supported on and axially movable with respect to the cylinder housing, the shoe being connected with the piston for being moved thereby, and the stripping jaw being mounted to the piston for being mounted to the shoe to be moved thereby;

the cylinder housing including a guide for the shoe and the shoe extending along the cylinder housing and being guided to move by the guide on the cylinder housing as the piston moves the shoe.

* * * * *